US012797687B2

(12) United States Patent
Barton

(10) Patent No.: US 12,797,687 B2
(45) Date of Patent: Nov. 17, 2026

(54) LONGITUDINALLY FOLDING SWIM FIN

(71) Applicant: Patrick Barton, Council Bluffs, IA (US)

(72) Inventor: Patrick Barton, Council Bluffs, IA (US)

( * ) Notice: Subject to any disclaimer, the term of this patent is extended or adjusted under 35 U.S.C. 154(b) by 253 days.

(21) Appl. No.: 18/668,692

(22) Filed: May 20, 2024

(65) Prior Publication Data

US 2025/0352859 A1 Nov. 20, 2025

(51) Int. Cl.
*A63B 31/11* (2006.01)

(52) U.S. Cl.
CPC ..... *A63B 31/11* (2013.01)

(58) Field of Classification Search
CPC .. A63B 31/11; A63B 2209/10; A63B 2210/50
See application file for complete search history.

(56) References Cited

U.S. PATENT DOCUMENTS

| | | | | |
|---|---|---|---|---|
| 4,250,584 | A * | 2/1981 | Korn | A63B 31/11 441/61 |
| 4,952,183 | A * | 8/1990 | Gil | A63B 31/11 441/55 |
| 4,981,454 | A | 1/1991 | Klein | |
| 5,242,321 | A | 9/1993 | Gil | |
| 5,924,902 | A | 7/1999 | Burns et al. | |
| 6,923,697 | B1 | 8/2005 | Wagner | |
| 8,087,959 | B2 | 1/2012 | Hsu | |
| 9,427,626 | B2 | 8/2016 | Ben-Arie | |
| 9,675,844 | B2 | 6/2017 | Stroud | |
| 10,029,148 | B2 | 7/2018 | Shieh | |
| 2004/0209534 | A1 | 10/2004 | Graham | |
| 2007/0167094 | A1 | 7/2007 | Moyal | |
| 2011/0104968 | A1 | 5/2011 | Johnson | |
| 2015/0133010 | A1 | 5/2015 | Donahue et al. | |
| 2016/0023053 | A1 | 1/2016 | Szymanski et al. | |
| 2021/0346763 | A1 | 11/2021 | O'Neill | |
| 2022/0184459 | A1 | 6/2022 | Godoy | |

FOREIGN PATENT DOCUMENTS

| | | | | |
|---|---|---|---|---|
| FR | 2575927 | A1 * | 7/1986 | A63B 31/10 |

OTHER PUBLICATIONS

Folding Fins®. Folding fins. Accessed May 9, 2024. (n.d.). https://foldingfins.com/products/folding-fins?variant=40809565225099.

* cited by examiner

*Primary Examiner* — Anthony D Wiest
(74) *Attorney, Agent, or Firm* — Dunlap Bennett & Ludwig PLLC; Anna L. Kinney

(57) ABSTRACT

A flexible fin may include a one-piece body having multiple batons inside of a flexible fabric blade, having sufficient rigidity for propulsion while retaining the flexibility to change the form factor when not in use. The fin can be fastened to a swimmer's foot with fastening straps attached to a surface of the one-piece body and can be adjustable in size to fit a variety of foot sizes.

9 Claims, 3 Drawing Sheets

LONGITUDINALLY FOLDING SWIM FIN

BACKGROUND OF THE INVENTION

The present invention relates to fins and, more particularly, to a longitudinally folding fin.

Traditional swim fins are large and made from durable, semi-rigid materials, such as rubber. Traveling with swim fins is difficult because of their material properties, they often take up excess space and weight, often weighing more than 5 pounds. Problems are further complicated if a swimmer, freediver, snorkeler, or Self-Contained Underwater Breathing Apparatus (SCUBA) diver requires a number of different types of fins during their travel. Currently, users who wish to travel with one or more pairs of swim and/or dive fins must bear excess costs and/or weight associated with bulky fins.

As can be seen, there is a need for a lightweight modular fin that can be collapsed for ease of storage and travel.

SUMMARY OF THE INVENTION

In one aspect of the present invention, a flexible fin is provided which includes a flexible body including at least a first foot strap, a second foot strap and a heel strap adapted to receive the foot of a swimmer. The flexible body of the fin is covered in a flexible material such as canvas cloth, polyester cloth, laminated membranes, or bonded filaments. A plurality of batons is disposed within the flexible material of the flexible body and can provide semi-rigid support to the fin, thereby allowing the fin to retain the ability to generate force for propelling a user in the water, while still providing the ability to change the form factor when the fin is not in use. The fin disclosed herein may be utilized for any water sports during which a person propels themself with footwear, including but not limited to SCUBA, swimming, snorkeling, or Freediving.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a longitudinally folding fin made from flexible and lightweight material which can be placed into a transport mode, which has a smaller form factor than prior art fins, while maintaining sufficient rigidity to provide propulsion force for a user while swimming.

As used herein, the term "fin" refers to any footwear used to propel a person in water, including but not limited to swim fins and diving fins.

In some embodiments, the fin may comprise a Keder Joint with a foot pocket.

The fin may comprise longitudinally positioned, spaced apart battens or batons of a selected rigidity/stiffness. The length of each batten is not particularly limited. Battens of various lengths may be interchanged to alter the length of the fin.

The fin may comprise a variety of foot straps, for example one which covers the user's whole foot.

The blade can be made of a lightweight flexible material that reduces the overall weight of the fin, as compared to a prior art rubber or plastic fin of similar size but retains sufficient rigidity to propel a user through water. The material may be, e.g., a fabric, such as but not limited to canvas cloth, polyester cloth, laminated membranes, or bonded filaments.

The fin may comprise a cross bracket formed, for example, of a fiberglass plastic composite. In some embodiments, the cross bracket may have slots formed therein to accommodate straps affixed to the fin blade.

The fin may be manufactured by any suitable method known in the art, such as by stitching components of the fin together.

Figure 1:
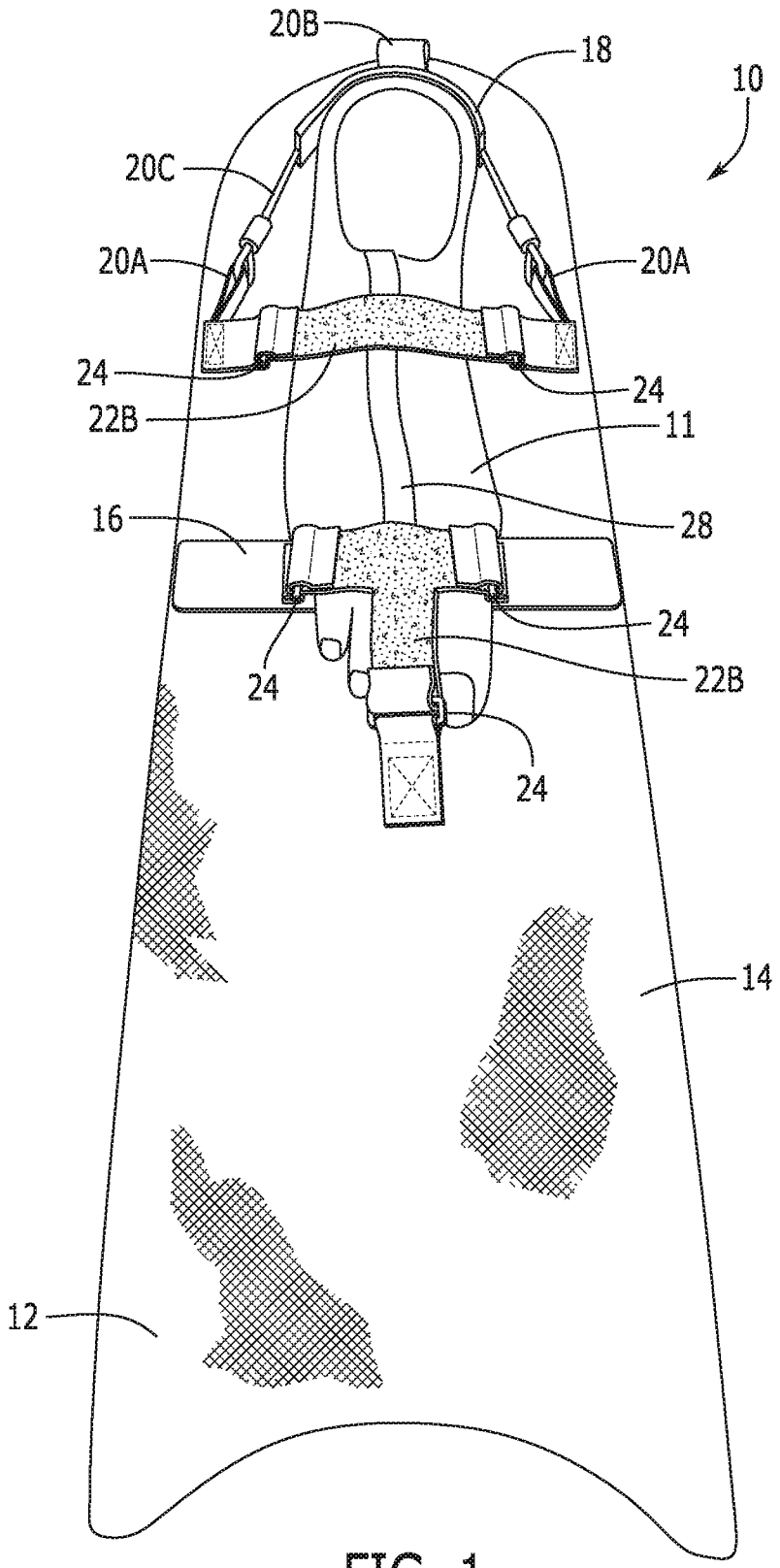
FIG. 1 is a top perspective view of a modular fin according to an embodiment of the present invention, shown in use.
Figure 2:
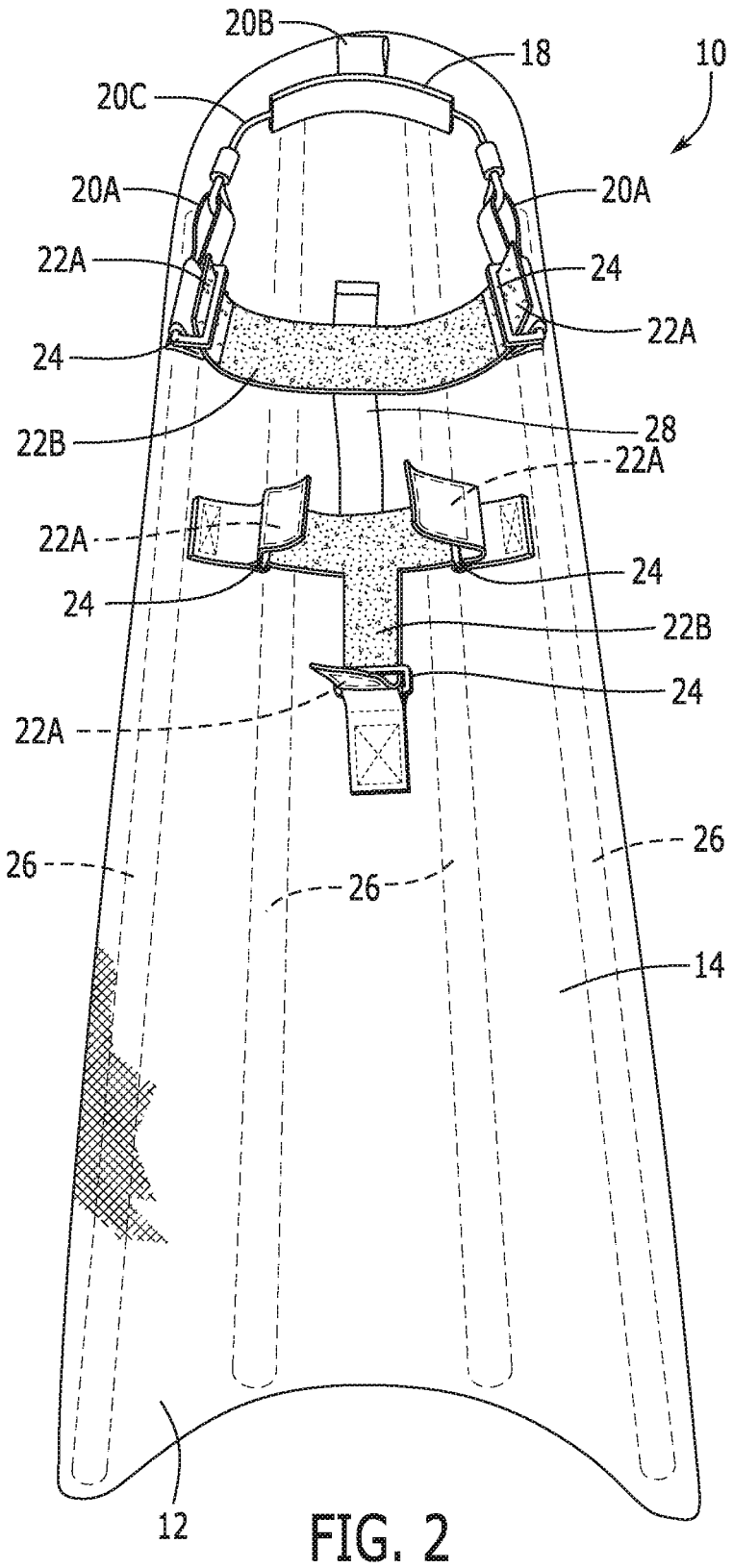
FIG. 2 is another top perspective view thereof.
Figure 3:
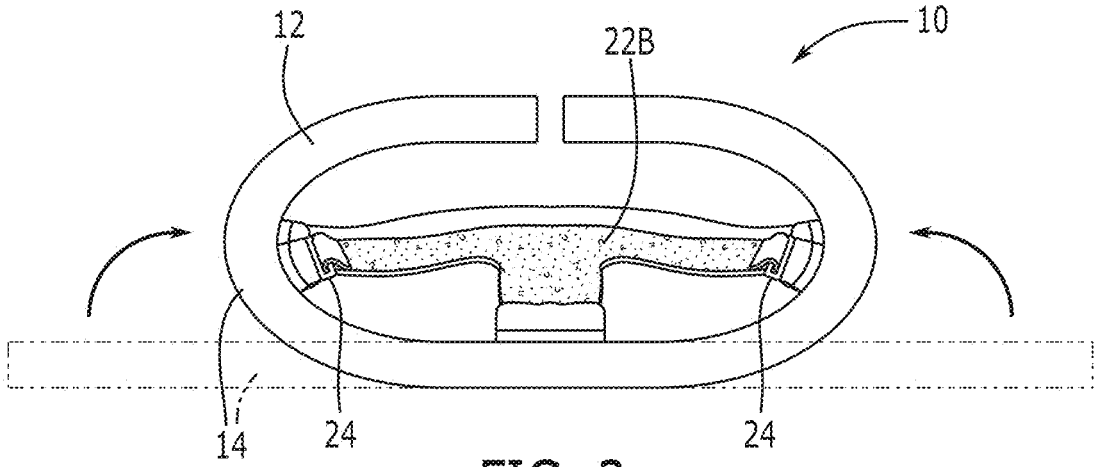
FIG. 3 is an end view thereof, shown in a travel condition.

Referring to FIGS. 1-3, an embodiment of a lightweight modular fin 10 is illustrated, according to aspects of the present invention.

FIG. 1 illustrates an overall view of the lightweight modular fin 10 mounted to a user's foot 11 and operative to propel the user when swimming in water. The fin 10 comprises a blade 14 with an ankle or heel strap 18, a lateral strap, and a "T"-shaped strap, each having hook and loop fastener surfaces 22A, 22B. At least the "T"-shaped strap with hook and loop fastener surfaces 22A, 22B can be disposed over the foot 11, proximate to the junction of the metatarsus and phalanges, and at least the lateral strap with hook and loop fastener surfaces 22A, 22B can be disposed over the foot 11, proximate to the junction of the metatarsus and the tarsus. A cross bracket 16 can be disposed laterally on a surface of the blade 14 to provide structural support, maintaining the blade 14 in an opened use position.

As shown in FIG. 2, a plurality of battens or batons 26 are disposed longitudinally inside of pockets in the material 12 to provide structural support and the rigidity necessary for the fin 10 to produce force sufficient to propel a user through water. The flexible material 12 with the rigid batons 26 enable the fin 10 to be folded, e.g., for packaging, and are lighter weight than a conventional rubber or plastic fin. The straps may be fastened to the blade 14 by way of a plurality of loops or buckles 24 affixed to the blade 14, each configured to accommodate an end of one of the straps such that a hook fastener portion 22A of the strap couples to the loop fastener portion 22B of the strap. The heel strap 18 comprises an elastic cord 20C with a tab loop 20B can be affixed to the buckles 24 securing the lateral strap by way of a pair of loops 20A. The lateral strap may be affixed to the "T"-shaped strap by way of a longitudinal strip of material or connecting strap 28. Advantageously, the plurality of hook and loop fasteners 22A, 22B and buckles 24 enable adjustment of the various straps to secure a variety of user's foot 11 sizes.

FIG. 3 illustrates a transport configuration of fin 10 that is advantageous over prior art fins that cannot provide the same level of flexibility. A user can place fin 10 in a transport configuration by folding or rolling the fin 10 lengthwise, thus creating a smaller form factor for transport. This configuration is accomplished using flexible fabric 12 in combination with flexible batons 26, which in combination are more compressible and flexible than traditional rubber or plastic fins.

It should be understood, of course, that the foregoing relates to exemplary embodiments of the invention and that modifications may be made without departing from the spirit and scope of the invention as set forth in the following claims.

What is claimed is:

1. A fin, comprising:

a flexible blade made from a fabric material including a plurality of batons disposed longitudinally within pockets of the fabric material;

a strap assembly affixed to a top surface of the flexible blade and adapted to receive a foot of a swimmer on the top surface; and a cross bracket attachable to the flexible blade, the cross bracket extending laterally across the flexible blade and configured to engage the strap assembly;

wherein the plurality of batons is configured to provide semi-rigid support to the blade along its length, with the fabric material foldably disposed between the batons.

2. The fin of claim 1, wherein the strap assembly comprises a heel strap, a lateral strap coupled thereto by way of at least one loop, and a T-shaped strap, wherein a connecting strap extends longitudinally between the T-shaped strap and the lateral strap.

3. The fin of claim 2, wherein the lateral strap and the T-shaped strap comprise hook and loop fasteners.

4. The fin of claim 2, wherein the heel strap comprises an elastic cord and a tab loop.

5. The fin of claim 1, wherein the fin has a use position and a folded position having a form factor smaller than the use position.

6. The fin of claim 1, wherein the fabric material is selected from the group consisting of: canvas cloth, polyester cloth, a laminated membrane, and a bonded filament.

7. The fin of claim 1, further comprising a foot pocket adapted to receive the foot of the swimmer.

8. The fin of claim 1, wherein the flexible blade and the strap assembly are joined by stitching.

9. The fin of claim 1, wherein the strap assembly comprises a heel strap, a first strap, and a second strap, wherein the first strap extends laterally across the flexible blade and is positioned between the heel strap and the second strap.

* * * * *